US007141750B2

(12) United States Patent
Yamada

(10) Patent No.: US 7,141,750 B2
(45) Date of Patent: Nov. 28, 2006

(54) SWITCH MECHANISM PROVIDED WITH SWITCH PLATE AND PRINTER APPARATUS PROVIDED WITH SWITCH MECHANISM

(75) Inventor: Masahiro Yamada, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/344,986

(22) Filed: Feb. 1, 2006

(65) Prior Publication Data

US 2006/0180446 A1 Aug. 17, 2006

(30) Foreign Application Priority Data

Feb. 3, 2005 (JP) ..... 2005-027469

(51) Int. Cl.
*H01H 13/14* (2006.01)
*H01H 3/12* (2006.01)

(52) U.S. Cl. ..... 200/341; 200/61.7; 200/537; 361/212

(58) Field of Classification Search ..... 200/341–343, 200/293, 296, 17 R, 61.61, 61.62, 61.69, 200/61.7, 520, 537; 361/212–214, 220
See application file for complete search history.

(56) References Cited

U.S. PATENT DOCUMENTS 5,396,396 A * 3/1995 Watanabe ..... 361/212
5,717,179 A * 2/1998 Meyer ..... 200/61.81
5,941,374 A * 8/1999 Hapke et al. ..... 200/345
6,486,423 B1 * 11/2002 Karasik et al. ..... 200/61.62

FOREIGN PATENT DOCUMENTS

| | | |
|---|---|---|
| JP | 5-15234 | 2/1993 |
| JP | 06-089631 | 3/1994 |
| JP | 07-282682 | 10/1995 |
| JP | 11-176302 | 7/1999 |

OTHER PUBLICATIONS

Patent Abstracts of Japan, Application No. 07-282682, dated Oct. 27, 1995 (2 pages).
Patent Abstracts of Japan, Application No. 06-089631, dated Mar. 29, 1994 (2 pages).
Patent Abstracts of Japan, Application No. 11-176302, dated Jul. 2, 1999 (2 pages).
Japan Patent Office, Application No. 5-15234, dated Feb. 26, 1993, with English translation (2 pages).

* cited by examiner

*Primary Examiner*—Richard K. Lee
(74) *Attorney, Agent, or Firm*—Osha Liang LLP

(57) ABSTRACT

A switch mechanism includes a switch body including a sensing button placed to protrude from a surface, a switch plate placed to face the sensing button and connected to the switch body, and a coil spring for biasing the switch body. The switch mechanism is formed such that when a protruding portion presses the switch plate, the switch plate presses the sensing button. The switch body is formed to be turnable in accordance with a direction along which the switch plate presses the sensing button. The coil spring is formed to bias the switch body in a direction opposite to the direction along which the sensing button is pressed, out of turning directions of the switch body.

3 Claims, 4 Drawing Sheets

SWITCH MECHANISM PROVIDED WITH SWITCH PLATE AND PRINTER APPARATUS PROVIDED WITH SWITCH MECHANISM

BACKGROUND OF THE INVENTION

1. Field of the Invention

The present invention relates to a switch mechanism and a printer apparatus provided with the switch mechanism.

2. Description of the Background Art

One type of switch mechanism, typified by a push button, for example, allows a switch to be turned on and off by the switch being pushed. Such a switch is formed to allow internal contact points to be connected together when a button portion is pressed, and allow the contact points to be disconnected when the button portion ceases to be pressed. Alternatively, there exists a switch that allows contact points to be set to the connected state from the disconnected state when a button portion is pushed once, and allows the contacts points to be set to the disconnected state from the connected state when the button portion is pushed again.

In addition to the switch that allows an operation of an electrical device to be started and halted by a button being pressed repeatedly, a switch mechanism also includes a switch that senses a predetermined state. For example, there exists a so-called interlock switch in an electrical device having an open/close door. When sensing that the open/close door is brought into the opened state, the interlock switch controls an internal mechanism such that the internal mechanism is not operated while the open/close door is opened. Another switch mechanism is a limit switch in an automatic open/close door or the like. The limit switch senses a complete opened state or complete closed state of the automatic open/close door, and thereby halts the operation of opening or closing the open/close door.

Japanese Patent Laying-Open No. 7-282682 discloses a switch mechanism in which a buffer is provided at a support portion of a circuit board having a switch mounted thereon. In this switch mechanism, when a switch button is pushed, pushing force acts upon a tact switch, and thereby switching operation is completed. At this time, even if the pushing force is excessive or destructive, the buffer made of a spring connected to the circuit board allows the circuit board to translate in a direction along which the pushing force acts thereupon. It is disclosed that the tact switch is consequently prevented from being damaged.

Furthermore, Japanese Patent Laying-Open No. 6-89631 discloses a push button structure in which when a push button is pressed with a larger force than is necessary, a base plate having a tact switch fixed thereon translates in a direction along which the push button is moved. In this push button structure, an elastic hinge portion is formed at a tip of the base plate, and the base plate slides in a direction along which the push button is moved. It is disclosed that even if the push button is pushed more strongly than necessary and moved in more than a predetermined operating stroke, the switch can be prevented from being damaged.

In the switch mechanism that allows contact points to be connected and disconnected by a button portion being pressed, an excessive load may be applied to the switch mechanism temporarily or destructively, resulting in that the switch mechanism may be damaged. When a button portion is pushed with a finger, for example, an excessive pushing force may be applied and thereby cause damage to the switch mechanism. Alternatively, when an open/close door provided with an interlock switch is slammed shut, for example, a button portion may temporarily be pushed in more deeply than a position that corresponds to a closed position of the open/close door, and thereby cause damage to the switch mechanism.

In the switch mechanism disclosed in Japanese Patent Laying-Open No. 7-282682 or Japanese Patent Laying-Open No. 6-89631, a base plate itself, at which a tact switch that serves as a button portion is provided, is formed to translate. It is therefore necessary to place a main surface of the base plate to be in parallel to a direction along which the button is pushed, which inevitably increases the size of the switch mechanism.

SUMMARY OF THE INVENTION

The present invention has been made in consideration of the aforementioned problem and, an object of the invention is to provide a switch mechanism that prevents a button portion from being damaged when an excessive load is applied thereto, and a printer apparatus provided with the switch mechanism.

The printer apparatus according to the present invention includes: a front cover connected to a frame body and formed to be openable and closable; a sensing portion for sensing an opened state and a closed state of the front cover; a spring holding tab fixed to the frame body; and a turning spindle fixed to the frame body. The front cover includes a protruding portion for driving the sensing portion. The sensing portion includes a base plate including a shaft insertion hole and a spring holding hole, a switch body fixed to a surface of the base plate and having a sensing button, a switch plate connected to the switch body and formed to extend to face the sensing button, a guide shaft placed to penetrate the shaft insertion hole in the base plate and restricting a movement of the base plate in a direction orthogonal to a turning direction of the base plate, and a coil spring hooked on the spring holding tab and in the spring holding hole. The switch body and the base plate are formed such that the turning spindle is inserted into the switch body to allow the switch body and the base plate to be turnable by allowing the turning spindle to serve as a fulcrum. The coil spring has elasticity in a direction along which the spring holding tab and the base plate approach. The printer apparatus is formed such that when the front cover is closed, the protruding portion presses the switch plate, and the switch plate in turn presses the sensing button. The printer apparatus is formed such that when the protruding portion is moved further inwardly than a closed position of the front cover, the switch body and the base plate turn to prevent the sensing portion from being damaged. The printer apparatus is formed such that when the front cover is opened, the protruding portion moves away from the switch plate, and the switch plate in turn moves away from the sensing button. By adopting the structure, it is possible to provide a printer apparatus preventing the button from being damaged when an excessive load is applied to the button.

A switch mechanism according to the present invention is a switch mechanism operated by a movable body including a contact portion, including: a switch body including a sensing button placed to protrude from a surface; a switch plate placed to face the sensing button and connected to the switch body; and an elastic member for biasing the switch body. The switch mechanism is formed such that when the movable body is moved and the contact portion presses the switch plate, the switch plate presses the sensing button. The switch body is formed to be turnable in accordance with a direction along which the switch plate presses the sensing button. The elastic member is formed to bias the switch body in a direction opposite to the direction along which the sensing button is pressed, out of turning directions of the switch body. By adopting the structure, it is possible to provide a switch mechanism preventing the button from being damaged when an excessive load is applied to the button.

Preferably, in the invention above, the switch mechanism further includes a spring holding tab fixed to a frame body, and a base plate having the switch body fixed thereon and formed to extend in one direction from the switch body. The elastic member includes a coil spring, and the coil spring is hooked on a tip portion in the one direction at the base plate, and on the spring holding tab. By adopting the structure, it is possible to form the elastic member with a simple structure.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

The following is a description of a switch mechanism and a printer apparatus provided with the switch mechanism according to an embodiment based on the present invention, with reference to FIGS. 1 to 6. A switch mechanism according to the present embodiment is a switch mechanism of an interlock switch for sensing whether a front cover is opened or closed in a printer apparatus.

Figure 1:
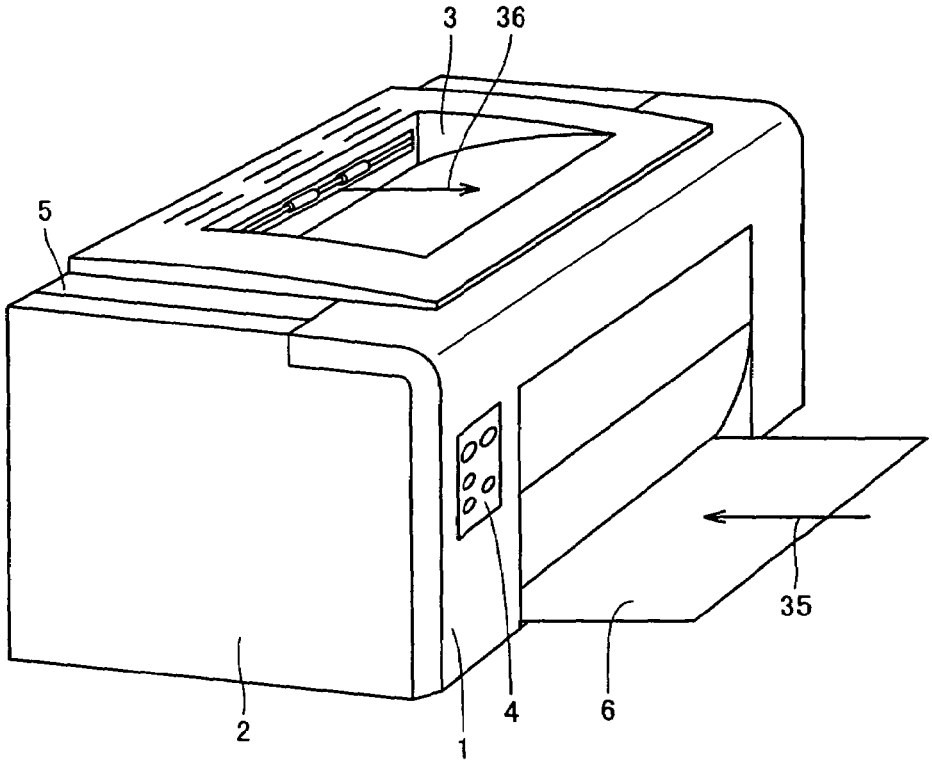
FIG. 1 is a schematic perspective view of a printer apparatus according to an embodiment based on the present invention.

FIG. 1 is a schematic perspective view of a printer apparatus according to the present embodiment. The printer apparatus according to the present embodiment is a laser beam printer apparatus in which toner is placed outside a photoreceptor drum so that the toner is transferred to the photoreceptor drum, and the transferred toner is further transferred to a printing substrate.

The printer apparatus according to the present embodiment includes a front cover 1 placed at the front, a side cover 2 placed at the side, and a top cover 5 placed at the top. A paper feed tray 6 is placed underneath front cover 1. A paper eject portion 3 is formed at front cover 5 of the printer apparatus. Furthermore, an operating portion 4 is placed at the front of the printer apparatus. The printer apparatus is formed such that a setting for printing, for example, can be made by allowing operating portion 4 to be operated.

When printing is performed, a paper sheet placed on paper feed tray 6 to serve as a printing substrate is fed into the printer apparatus as shown with an arrow 35. Printing is performed on the printing substrate inside the printer apparatus. The printed printing substrate is then ejected to paper eject portion 3 as shown with an arrow 36.

Figure 2:
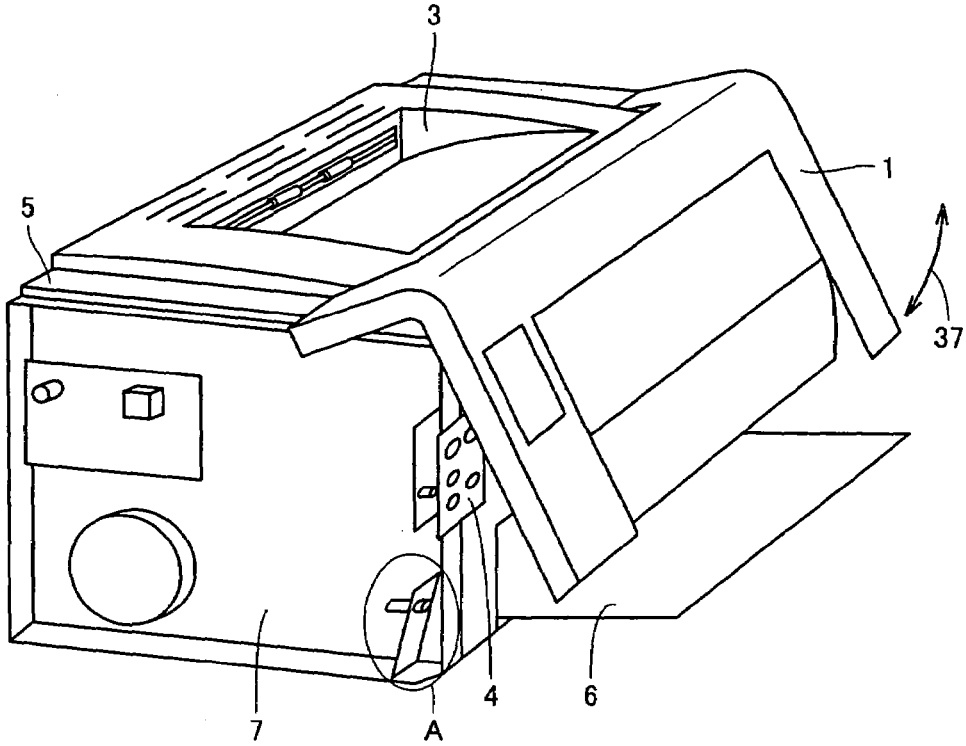
FIG. 2 is a schematic perspective view of the printer apparatus according to the embodiment based on the present invention, with its side cover removed and its front cover opened.

FIG. 2 is a schematic perspective view of the printer apparatus with the side cover removed. A frame body 7 is formed inside the side cover and front cover 1. Frame body 7 is made of metal or the like, and supports a device placed inside the printer apparatus. Operating portion 4 is fixed to frame body 7.

Front cover 1 serving as a movable body is connected to frame body 7, and formed to be turnable as shown with an arrow 37. In the present embodiment, front cover 1 is formed to have a turning shaft at the top portion thereof in a width direction. The printer apparatus is provided with a sensing portion for sensing an opened state and a closed state of front cover 1. A portion A in FIG. 2 corresponds to the sensing portion.

Figure 3:
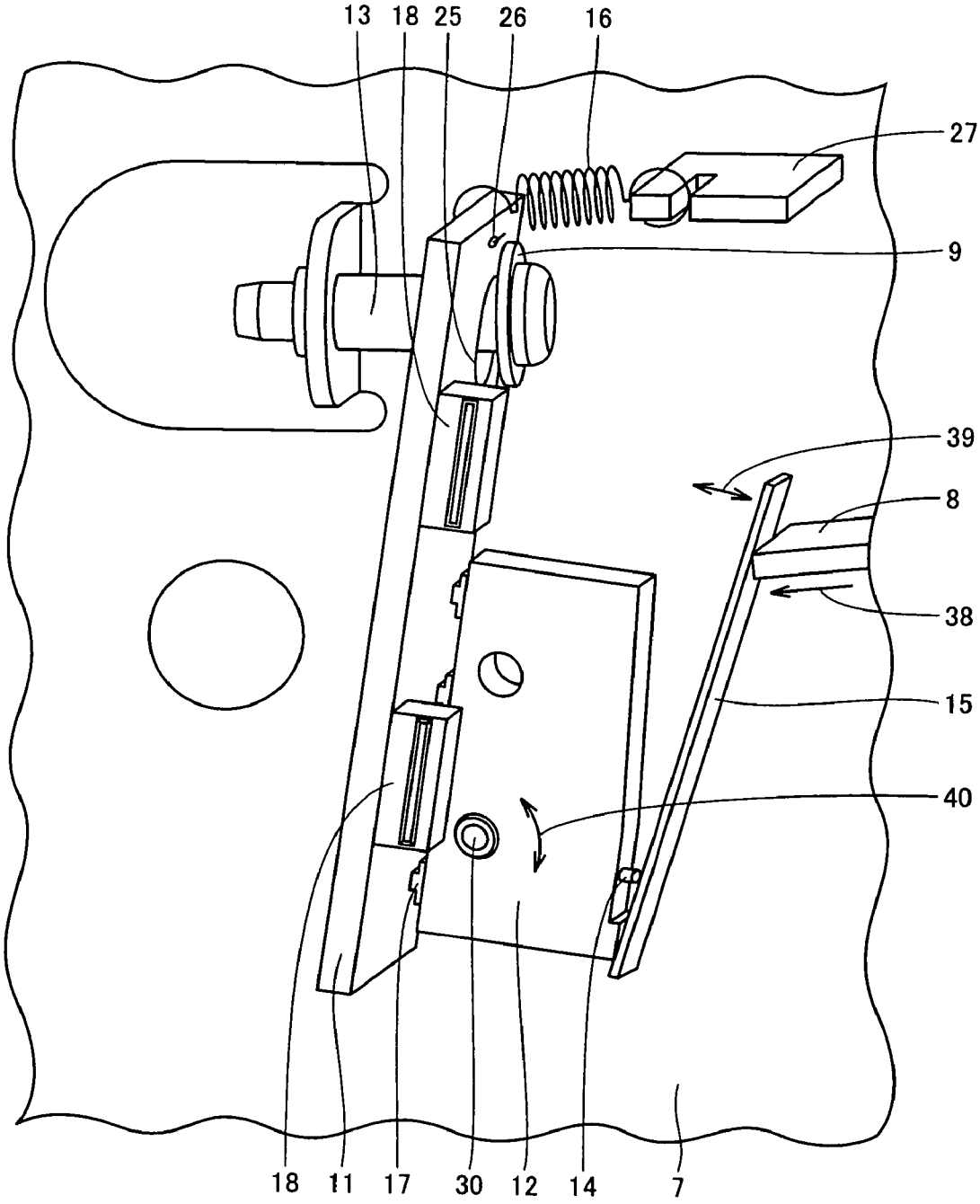
FIG. 3 is an enlarged schematic perspective view of a sensing portion according to the embodiment based on the present invention.

FIG. 3 is an enlarged schematic perspective view of the sensing portion. The front cover includes a protruding portion 8 for driving the sensing portion. Protruding portion 8 is formed to protrude from an inner surface of the front cover to the inside of the printer apparatus. In the present embodiment, protruding portion 8 is formed to be a rectangular parallelepiped, and an end face of protruding portion 8 drives the sensing portion. Protruding portion 8 is formed as a contact portion for being brought into contact with a switch plate 15. The length of protruding portion 8 in a width direction is made to be larger than the length of switch plate 15 in a width direction.

The sensing portion includes a base plate 11, and a switch body 12 fixed to the surface of base plate 11 and having a sensing button 14. Base plate 11 in the present embodiment is formed to be a flat plate having a rectangular shape in plan view. Base plate 11 is placed to extend from one end to the other end of switch body 12. Switch body 12 is formed to be a rectangular parallelepiped, and placed such that one surface of switch body 12 is made parallel to a surface of frame body 7.

Sensing button 14 is placed at an end surface of switch body 12 and formed to protrude from this end surface. Sensing button 14 is biased in a direction along which it protrudes, and connected to an electric circuit formed inside switch body 12. The electric circuit inside the switch body 12 is connected to an electric circuit formed at the base plate via a connecting terminal 17, and further connected to an electric circuit of the printer apparatus body via a connector 18.

The sensing portion includes switch plate 15 fixed to switch body 12 and formed to extend to face sensing button 14. Switch plate 15 is supported at the lower end of switch body 12, and formed to be turnable in a direction shown with an arrow 39. Switch plate 15 is formed to be rectangular in plan view. Switch plate 15 is placed such that when the front cover is closed, protruding portion 8 is brought into contact with switch plate 15 to push switch plate 15 in a direction shown with an arrow 38. Sensing button 14 is placed such that it is pushed in by switch plate 15 when protruding portion 8 pushes switch plate 15.

A turning spindle 30 is fixed to frame body 7. Turning spindle 30 is formed to be cylindrical, and to protrude from the surface of frame body 7. A through hole, circular in plan view, is formed at switch body 12 to allow turning spindle 30 to fit thereinto. Base plate 11, switch body 12, and switch plate 15 are formed to be turnable in an integral manner in a direction shown with an arrow 40.

A guide shaft 13 is fixed to frame body 7. Guide shaft 13 includes an elongated portion with a cylindrical shape in a front-back direction of the printer apparatus, and a flange portion 9. Flange portion 9 is formed at the end of guide shaft 13 on a side where front cover 1 is placed. Flange portion 9 is formed to prevent base plate 11 from being dropped off from the guide shaft.

A spring holding tab 27 is fixed to the frame body. Spring holding tab 27 is formed to protrude from the surface of frame body 7 to the outside of the printer apparatus. A notched portion is formed at spring holding tab 27 so that one end of a coil spring 16 is hooked on spring holding tab 27.

A shaft insertion hole 25 is formed at base plate 11. Shaft insertion hole 25 is formed such that the length in a width direction is made to be approximately similar to the diameter of the cylindrical portion of guide shaft 13, while the length in a direction orthogonal to the width direction is made to be sufficiently larger than the diameter of the cylindrical portion of guide shaft 13. In other words, shaft insertion hole 25 is an elongate hole whose longitudinal direction is approximately parallel to a longitudinal direction of base plate 11. A spring holding hole 26 is formed at the upper end of base plate 11. Spring holding hole 26 is formed such that the other end of coil spring 16 is hooked therein.

Coil spring 16 is formed as an elastic member for biasing the switch body. One end of coil spring 16 is hooked on spring holding tab 27, while the other end of coil spring 16 is hooked in spring holding hole 26. Coil spring 16 has elasticity in a direction along which spring holding tab 27 and base plate 11 are attracted to each other. In other words, coil spring 16 has elasticity in a direction along which it shrinks.

Turning spindle 30 is placed adjacently to an end of base plate 11 in the extending direction thereof, on a side opposite to the side where coil spring 16 is connected.

Figure 4:
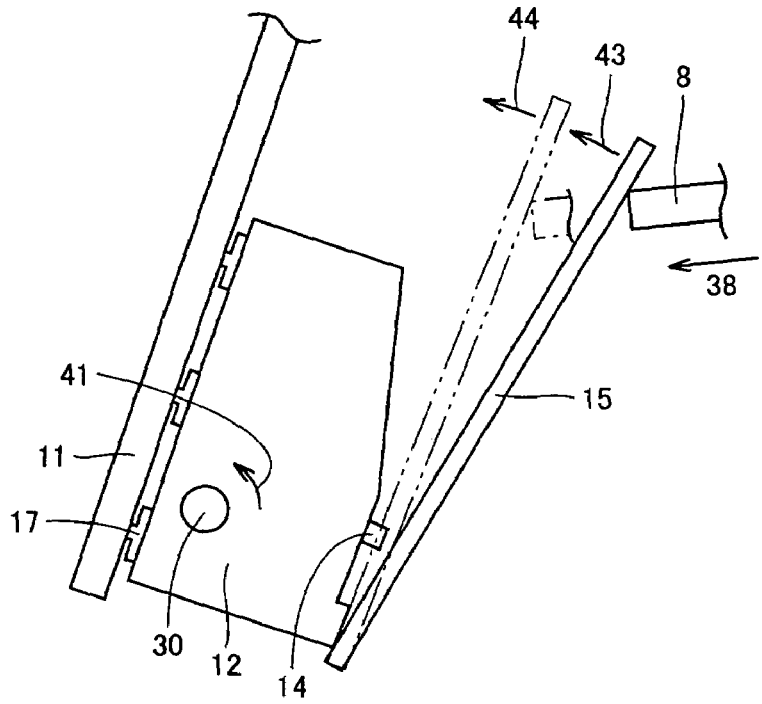
FIG. 4 is an enlarged schematic side view of the sensing portion according to the embodiment based on the present invention.

FIG. 4 is a schematic side view of the switch body when the front cover is closed. Referring to FIGS. 3 and 4, when the front cover is closed, protruding portion 8 of the front cover is brought into contact with the upper end of switch plate 15 and presses the same, as shown with arrow 38. Protruding portion 8 causes the upper end of switch plate 15 to move. Switch plate 15 turns as shown with an arrow 43, and thereby sensing button 14 of switch body 12 is pushed. As such, sensing button 14 is pushed and the front cover is sensed to be in a closed state.

When the front cover is gently opened and closed as usual, only the switch plate moves as shown with arrow 39, and base plate 11 and switch body 12 remain at rest. However, if the front cover is slammed shut, or if a man or the like collides with front cover 1 when the front cover is closed, for example, protruding portion 8 is then moved further inwardly than a position corresponding to a closed position of the front cover.

The front cover is deflected, for example, and thereby protruding portion 8 is moved further inwardly in the printer apparatus than a usual rest position. At this time, as shown with an arrow 44, force that allows the upper end of switch plate 15 to move further inwardly is applied. When protruding portion 8 is moved further inwardly than a position corresponding to a closed position of front cover 1, switch plate 15, switch body 12, and base plate 11 integrally turn as shown by an arrow 41 by allowing turning spindle 30 to serve as a rotation axis.

Figure 5:
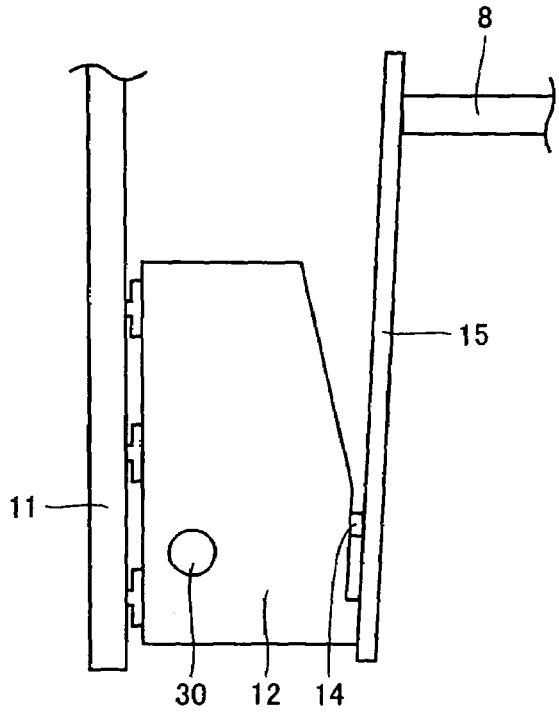
FIG. 5 is another enlarged schematic side view of the sensing portion according to the embodiment based on the present invention.
Figure 6:
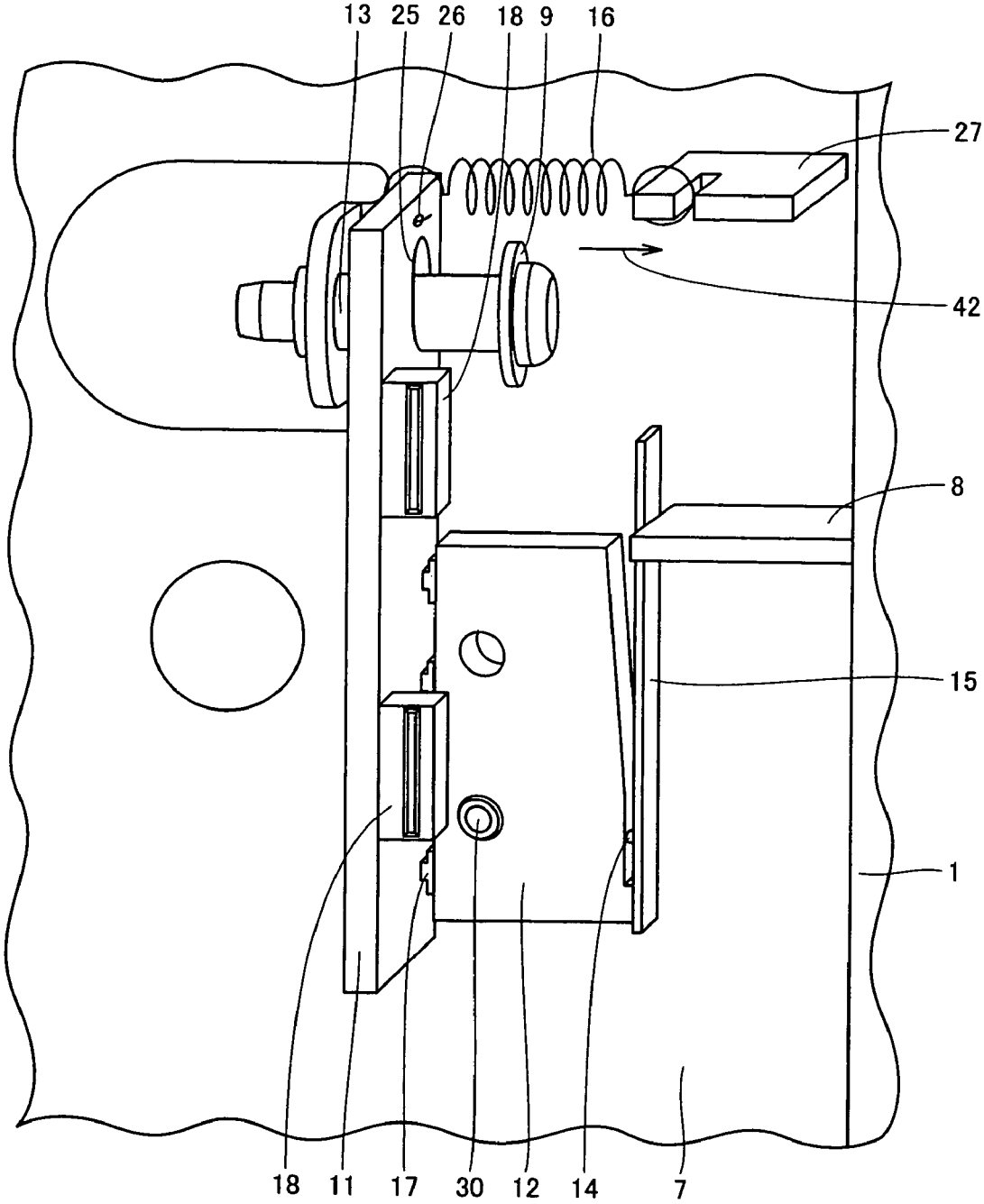
FIG. 6 is an enlarged schematic perspective view of the sensing portion according to the embodiment based on the present invention, when an excessive load is applied thereto.

FIG. 5 is a side view of the switch portion when the protruding portion is moved further inwardly than a rest position corresponding to a closed position of the front cover, and FIG. 6 is a schematic perspective view of the same. Switch body 12, base plate 11, and switch plate 15 turn such that base plate 11 placed to tilt is allowed to turn into an upright position, when seen from the side, and come to rest. Sensing button 14 remains pushed and its internal contact points are kept connected. Furthermore, the switch mechanism is prevented from being damaged.

Referring to FIG. 6, base plate 11 turns along guide shaft 13. In other words, guide shaft 13 is formed to penetrate base plate 11, and hence it is possible to prevent base plate 11 from moving in a direction orthogonal to the turning direction thereof, which allows smooth turning of base plate 11.

Base plate 11 turns, and thereby coil spring 16 stretches. Base plate 11 is biased such that spring holding hole 26 is moved toward spring holding tab 27, by allowing turning spindle 30 to serve as the turning center. In other words, the upper end of base plate 11 is biased in a direction as shown with an arrow 42.

In most cases, protruding portion 8 is moved further inwardly than a position corresponding to the closed position of front cover 1 for a short period of time. If an impact exerted on the front cover is eliminated, for example, elasticity of coil spring 16 allows each of base plate 11 and switch body 12 to move back to the original position as shown in FIG. 4. During this time period, sensing button 14 still remains pushed.

When the front cover is to be opened, the protruding portion of the front cover is moved away from the switch plate, and the switch plate is in turn moved away from the sensing button. The front cover is opened, and thereby the contact point of the sensing button are brought into the disconnected state.

As such, in the present embodiment, the printer mechanism is formed such that the contact portion of the movable body presses the switch plate, and thereby the switch plate presses the sensing button. The switch body is formed to be turnable in a direction along which the switch plate presses the sensing button. The elastic member is formed to bias the switch body in a direction opposite to the direction along which the sensing button is pressed, out of turning directions of the switch body. With this structure, even if an excessive load such as an impact is applied to the switch mechanism, it is possible to prevent the switch mechanism from being damaged. In addition, the switch mechanism according to the present embodiment can be formed without the use of molded products. It is therefore possible to reduce manufacturing costs.

Furthermore, in the present embodiment, the switch mechanism includes a spring holding tab fixed to the frame body, and a coil spring serving as an elastic member for biasing the switch body. The coil spring is hooked on the tip of the base plate and the spring holding tab. By adopting this structure, the above-described elastic member can easily be formed.

In the present embodiment, a protruding portion is formed at the front cover to serve as a contact portion for pressing the switch plate. However, the structure of the protruding portion is not limited thereto as long as the movable body is moved to press the switch plate.

In the present embodiment, the switch plate is connected to the switch body and formed to be turnable. However, the structure of the switch plate is not limited thereto as long as it is formed to press the sensing button. For example, the switch plate may be formed such that it can be curved and that one end thereof is fixed to the switch body.

Furthermore, the elastic member for biasing the switch body is not limited to a coil spring, and a plate spring or the like may be used therefor. Any structure of the turning spindle, which is inserted into the switch body, may be used as long as it is placed to allow the switch body to be turnable. For example, the turning spindle may be connected to the base plate.

In the present embodiment, the turning spindle and the spring holding tab are formed at the frame body. However, the structure thereof is not limited thereto. A resin-made part may be fixed to the inner side of the frame body, and at the resin-made part, the turning spindle, the spring holding tab and the like may be formed.

The switch mechanism according to the present embodiment is formed as an interlock switch of a front cover of a printer apparatus. However, the structure of the switch mechanism is not limited thereto. The present invention can be applied to any of switch mechanism that requires an operation of pushing the sensing button. For example, the present invention can be applied to the power switch of a television receiver.

According to the present invention, it is possible to provide a switch mechanism preventing a button portion from being damaged when an excessive load is applied to the button portion, and a printer apparatus provided with the switch mechanism.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer apparatus, comprising:

a front cover connected to a frame body and formed to be openable and closable;

a sensing portion for sensing an opened state and a closed state of said front cover;

a spring holding tab fixed to said frame body; and a turning spindle fixed to said frame body, wherein said front cover includes a protruding portion for driving said sensing portion, said sensing portion includes a base plate including a shaft insertion hole and a spring holding hole, a switch body fixed to a surface of said base plate and having a sensing button, a switch plate connected to said switch body and formed to extend to face said sensing button, a guide shaft placed to penetrate said shaft insertion hole in said base plate and restricting a movement of said base plate in a direction orthogonal to a turning direction of said base plate, and a coil spring hooked on said spring holding tab and in said spring holding hole, said switch body and said base plate are formed such that said turning spindle is inserted into said switch body to allow said switch body and said base plate to be turnable by allowing said turning spindle to serve as a fulcrum, said coil spring has elasticity in a direction along which said spring holding tab and said base plate approach, said printer apparatus is formed such that when said front cover is closed, said protruding portion presses said switch plate, and said switch plate in turn presses said sensing button, said printer apparatus is formed such that when said protruding portion is moved further inwardly than a closed position of said front cover, said switch body and said base plate turn to prevent said sensing portion from being damaged, and said printer apparatus is formed such that when said front cover is opened, said protruding portion moves away from said switch plate, and said switch plate in turn moves away from said sensing button.

2. A switch mechanism operated by a movable body including a contact portion, comprising:

a switch body including a sensing button placed to protrude from a surface;

a switch plate placed to face said sensing button and connected to said switch body; and an elastic member for biasing said switch body, wherein said switch mechanism is formed such that when said movable body is moved and said contact portion presses said switch plate, said switch plate presses said sensing button, the switch body is formed to be turnable in accordance with a direction along which said switch plate presses said sensing button, and said elastic member is formed to bias said switch body in a direction opposite to the direction along which said sensing button is pressed, out of turning directions of said switch body.

3. The switch mechanism according to claim 2, further comprising a spring holding tab fixed to a frame body, and a base plate having said switch body fixed thereon and formed to extend in one direction from said switch body, wherein said elastic member includes a coil spring, and said coil spring is hooked on a tip portion in said one direction at said base plate, and on said spring holding tab.

* * * * *